US005241841A

United States Patent [19]

Schmid et al.

[11] Patent Number: 5,241,841

[45] Date of Patent: Sep. 7, 1993

[54] KNITTING TAKE-OFF DEVICE FOR FLAT KNITTING MACHINES

[75] Inventors: Franz Schmid, Bodelshausen; Thomas Stoll, Reutlingen, both of Fed. Rep. of Germany

[73] Assignee: H. Stoll GmbH & Co., Reutlingen, Fed. Rep. of Germany

[21] Appl. No.: 757,529

[22] Filed: Sep. 11, 1991

[30] Foreign Application Priority Data

Sep. 24, 1990 [DE] Fed. Rep. of Germany ..... 4030161

[51] Int. Cl.[5] ..... D04B 15/90

[52] U.S. Cl. ..... 66/149 R; 66/152

[58] Field of Search ..... 66/104, 109, 110, 149 R, 66/147, 150, 148, 152, 120

[56] References Cited

U.S. PATENT DOCUMENTS

| | | | |
|---|---|---|---|
| 3,375,683 | 4/1968 | Joseph | 66/150 X |
| 3,376,716 | 4/1968 | Joseph | 66/150 |
| 3,618,343 | 11/1971 | Essig | 66/150 X |
| 4,488,416 | 12/1984 | Shima et al. | 66/149 R |
| 4,503,690 | 3/1985 | Goller et al. | 66/149 R |
| 5,040,384 | 8/1991 | Shima | 66/149 R |

FOREIGN PATENT DOCUMENTS

| | | | |
|---|---|---|---|
| 1221757 | 6/1966 | Fed. Rep. of Germany | 66/149 R |
| 1585002 | 10/1971 | Fed. Rep. of Germany . | |
| 1585207 | 5/1972 | Fed. Rep. of Germany . | |
| 2427117 | 1/1976 | Fed. Rep. of Germany | 66/149 R |
| 579475 | 8/1958 | Italy | 66/149 R |
| 519512 | 8/1976 | U.S.S.R. | 66/149 R |
| 0874795 | 10/1981 | U.S.S.R. | 66/149 R |
| 2118216 | 10/1983 | United Kingdom | 66/149 R |

*Primary Examiner*—Clifford D. Crowder
*Assistant Examiner*—Larry D. Worrell, Jr.
*Attorney, Agent, or Firm*—Larson and Taylor

[57] ABSTRACT

In a knitting take-off device provided with gripping elements (14) movable through the comb gap of a flat bed knitting machine, the plane of the gripping elements (14) is directed perpendicular to the hooking planes of the knitting needles (13) mounted in the needle beds. As a result, the dimensions of the gripping elements are no longer limited by the width of the comb gap, and the gripping elements (14) can be coupled to additional elements, such as a cover stop rod (16). By means of the cover stop rod (16), the opening (14.2) of the gripping element (14) can be closed and a thread take-up space (20), closable by the head (14.1) of the gripping element (14), can be formed.

1 Claim, 2 Drawing Sheets

KNITTING TAKE-OFF DEVICE FOR FLAT KNITTING MACHINES

FIELD OF THE INVENTION

The invention relates to a knitting device (sometimes called a take-down device) for flat bed knitting machines, having a row of gripping elements movable upwards and downwards through the comb gap defined by two needle beds, intended for gripping a piece of knitting.

BACKGROUND OF THE INVENTION

In flat bed knitting machines with a fine needle gauge, the comb gap between the needle beds can be so narrow that, in knitting take-off devices of the type mentioned above, the hook-shaped gripping elements must be made very thin and small in order to permit the elements to be guided through the comb gap. As a result, the gripping elements become unstable and can be bent in an undesirable manner well out of their adjustment plane by the tension exerted by knitting threads which have been grasped thereby. Moreover, there is a risk that no threads at all of the knitting edge will be grasped by the small hooks of many take-off hooks of a take-off hook strip.

SUMMARY OF THE INVENTION

It is the object of the invention to construct a knitting take-off device of the type mentioned above, such that the gripping elements can, independently of the comb gap width of a machine, can always be constructed with sufficient strength and a sufficiently large hook opening, that secure grasping of a knitting thread located in the adjustment region of a gripping element is guaranteed.

The stated object is achieved in accordance with the invention, in a knitting take-off device as described above, by providing that the hooking plane of the gripping elements is directed perpendicular to the hooking planes of the knitting needles mounted in the needle beds, and that the opening of the gripping elements is constructed so that the opening can be closed.

In the knitting take-off device constructed in accordance with the invention, the hooking planes of the gripping elements, in contrast to take-off devices hitherto known, lie in a central plane running through the comb gap of two needle beds of a flat bed knitting machine. Thus, the hook size is no longer dependent on the width of the comb gap. In addition, there is a substantially greater degree of freedom in the shaping of the gripping elements than in the case of the take-off hooks used hitherto. The comb gap width only limits the maximum possible thickness of a gripping element but still permits a gripping element thickness to be chosen for the narrowest known comb gap of a flat bed knitting machine which still provides the gripping element with adequate stability, i.e., strength or resistance to pending.

The fact that the gripping element opening is closable allows, in the knitting take-off device according to the invention, bringing of the gripping elements into the knitting edge, as well as amplification of the subsequent uncoupling of the gripping elements from the knitting to this end, each gripping element may advantageously be arranged to be relatively displaceable in the take-off direction with respect to a cover stop rod which has a thread take-up recess or space, closable by the gripping element, and a section for closing the gripping element opening. The thread take-up space, closable by the gripping element, allows a grasped knitting thread to remain held, in a manner similar to a closed 2-piece compound needle, during the entire take-off procedure, and eliminates the risk of threads of the knitting edge popping out of individual gripping elements during the take-off procedure. It will be appreciated that such popping out of threads would prevent a uniform distribution of the take-off forces on the knitting edge. The thread take-up space of the cover stop rod may, in accordance with the invention, have edges rising obliquely with respect to its opening, with the front edge, as viewed in the direction of knitting take-off, being longer and ending in a thread deflection tip projecting over the associated gripping element. The transverse position of the gripping elements with respect to the knitting needles means that a thread deflection tip projecting over the gripping element can quite easily be constructed. As a result of this, when the take-off device rises into the comb gap, a thread of the knitting edge is more easily grasped, and can then slide along the longer edge of the thread take-up space into this thread take-up space, where the thread is then held by the associated gripping element.

The gripping element and its associated cover stop rod can both be constructed as flat bodies lying closely against one another. However, even the smallest comb gap of a flat bed knitting machine permits a thicker cover stop rod to be constructed, in which a guide groove for the gripping element is constructed and which thus at the same time provides guidance for the gripping elements.

A knitting take-off device constructed in accordance with the invention requires no special form of knitting edge but rather can be used with all conventional forms of knitting edge. In the case of initial courses in which thread loops or stitches are formed only by individual needles which are arranged spaced from one another over a plurality of needle divisions, a uniformly distributed grasping of the initial knitting threads can also be ensured by a particular take-off process with the aid of the knitting take-off device. To this end, in accordance with the invention, after the formation of at least one right/right initial course, raising of the gripping elements and the cover stop rods into the comb gap can first take place, with the thread take-up space of the cover stop rods being released, i.e. opened, by the gripping element. Then, one of the two needle beds can be offset by at least one needle division before the thread take-up space of the cover stop rods is closed by the gripping element and the gripping elements are withdrawn out of the comb gap before or after return of the needle bed begins. When the needle bed is offset, an initial thread of the knitting is pushed into each of the cover stop rods and is then held by the gripping element in the cover stop rod, so that when the needle bed returns the thread cannot come out of the thread take-up space again.

BRIEF DESCRIPTION OF THE DRAWINGS

An embodiment of a knitting take-up device is described by way of example only, in more detail below with reference to the attached drawings. The drawings are restricted to the illustration of one of the plurality of gripping elements and the cover stop rod associated therewith of the knitting take-up device provided with a plurality of gripping elements in conventional manner.

In the drawings.

DESCRIPTION OF THE PREFERRED EMBODIMENT

Figure 1:
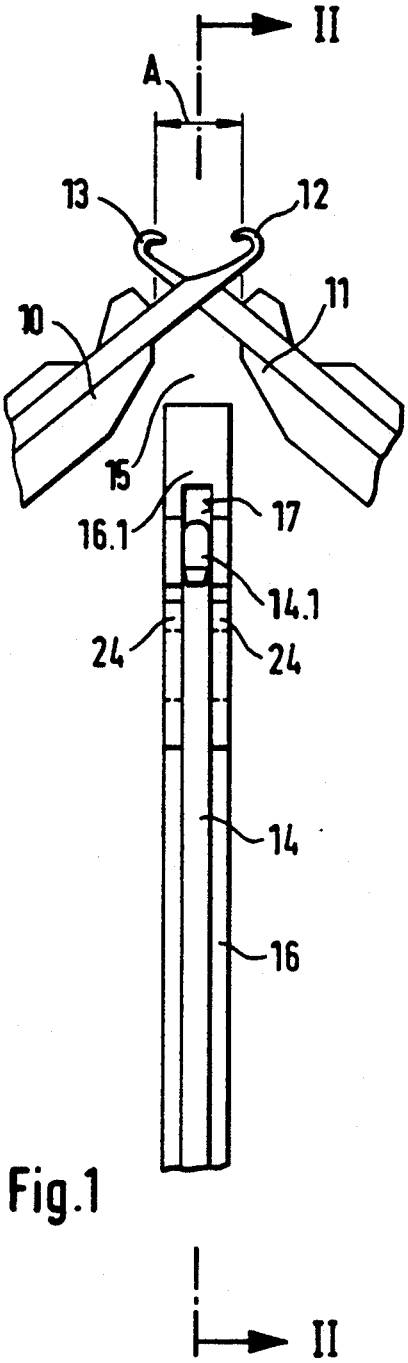
FIG. 1 shows a partial side view of a gripping element and its cover stop rod in a position below the comb gap of a flat bed knitting machine.

In FIG. 1, of a flat bed knitting machine, only the two edge regions, limiting the comb gap 15 of the machine, of two needle beds 10 and 11 are illustrated. A knitting needle 12 mounted in the needle bed 10 and a knitting needle 13 mounted in the needle bed 11 are shown, whereby the hooking plane runs in or parallel to the plane of the drawing and thus transversely to the plane of symmetry of the comb gap 15, which coincides with the plane of section II—II. The width of the comb gap 15 is designated A.

Of the overall knitting take-off device, the only essential parts are illustrated, these including a gripping element 14 having a hook head 14.1 and a cover stop rod 6, in which the gripping element 14 is mounted relatively displaceable in its longitudinal direction. The drive means for the individual gripping elements 14 and cover stop rods 16 of the knitting take-off device and the coupling thereof to the respectively adjustable parts are not illustrated. For this purpose, various constructional elements, including those known from other adjustable parts of knitting machines, can be used.

Figure 2:
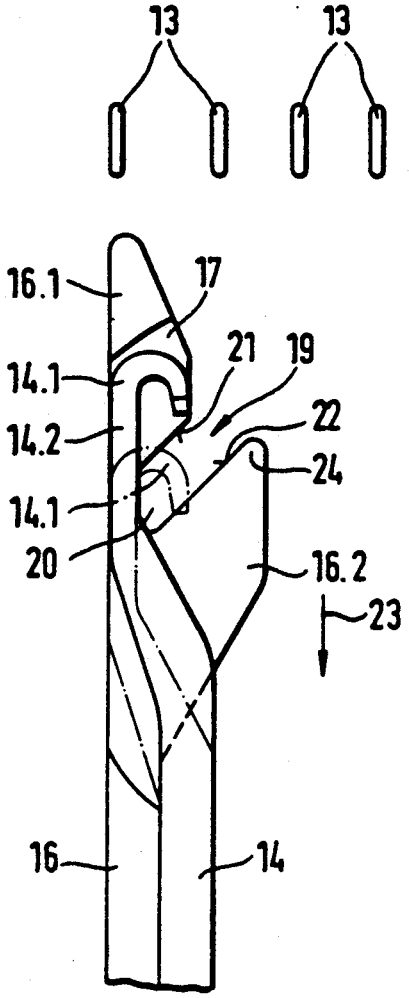
FIG. 2 shows a longitudinal section through the cover stop rod and the gripping element, taken along the line II—II in FIG. 1.
Figure 3:
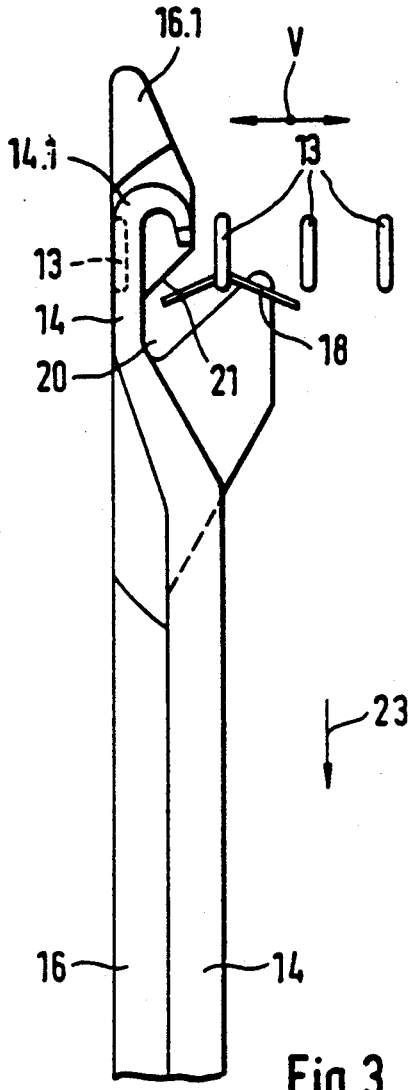
FIG. 3 shows an illustration corresponding to FIG. 2, in which the cover stop rod and the gripping element are displaced upwards through the comb gap to grasp a knitting starting thread.

The shaping of the gripping element 14 and the cover stop rod 16 can be seen from FIGS. 2 and 3. In these illustrations, some heads of the needles 13 of one needle bed 11 are shown, this needle bed being constructed such that it may be offset with respect to the other needle bed 10. A double-headed arrow V indicates that the needle bed 11 may be offset respectively by one needle division to the right or to the left.

The gripping element 14 is, in the example embodiment illustrated, mounted in a groove 17 of the cover stop rod 16, which ends in a head part 16.1 of the cover stop rod and allows the hook head 14.1 of the gripping element to penetrate entirely into this head part 16.1. The gripping element 14 is shown in in solid lines in this position in all the figures. In this position, its hook head 14.1 is thus closed by the cover stop rod 16 and cannot grasp a knitting thread 18 (FIG. 3). At the cover head 16.1 of the cover stop rod 16, an edge cut-out 19 forms a thread take-up recess or space 20 which has edges 21 and 22 rising obliquely with respect to the opening of the edge cut-out 19. The front edge 22, as seen in the take-off direction indicated by an arrow 23, is longer than the rear edge 21 and ends in a thread deflection tip 24 which is constructed on a part 16.2 of the cover stop rod 6 projecting well over the hook head 14.1 of the gripping element 14. The edge cut-out 19 forming the thread take-up space 0 and the cover stop rod part 16.2 forming the thread deflection tip are divided by the longitudinal groove 17 respectively into two equal parts, as can be seen from FIG. 1 for the thread deflection tip 24.

In FIG. 2, the gripping element 14 is shown in dot-and-dashed lines in a position relatively displaced with respect to the cover stop 16 in which the hook head 14.1 closes the take-up space 20 of the cover stop rod 16. The gripping element 14 is brought into this position after the take-off device in with FIG. 3 has been brought upwards through the comb gap knitting threads 18 have been threaded into the thread take spaces 20 of the cover stop rods 16, before the take-off movement of the knitting take-off device then begins in the direction of the arrow 23.

In the position of the take-off parts and the relative position of gripping element 14 and cover stop rod 16 shown in FIG. 3, the needle bed offset, mentioned above, can take place in the direction of the arrows V, in order to force a knitting thread 18 to enter the thread take-up space 20 of the cover stop rod 16. The grasped thread 18 held in the thread take-up space 20 is released again, after conclusion of the take-up movement, by the hook head 14.1 penetrating into the cover part 16.1 of the stop rod 16, and can slide out of the edge cut-out 19 of the cover stop rod 16 along the oblique edge 21.

Figure 4:
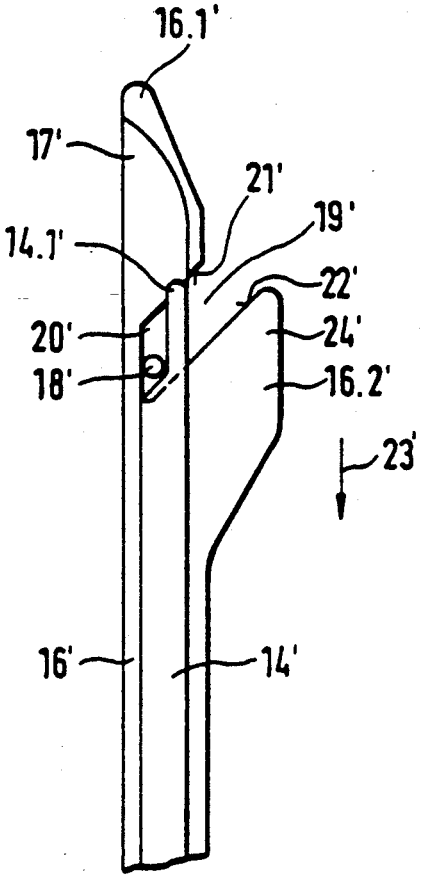
FIG. 4 shows an illustration corresponding to FIG. 2, of a modified embodiment.

FIG. 4 shows an embodiment of a take-off element in which the gripping element (14') has been formed purely as a closing element, omitting a hook head, this closing element closing or releasing the thread take-up space (20) of the cover stop rod (16') by means of a head part (14.1'). The shape of the cover stop rod (16') is substantially the same as in the embodiment shown in FIGS. 1 to 3, with only its cover part (16.1') being of a slightly different shape to match the head part (14.1'). Parts corresponding to the embodiment in accordance with FIGS. 1 to 3 are designated by the same reference numerals with a prime attached.

We claim:

1. A flat bed knitting machine having a knitting set-up comprising:

front and rear needle beds defining a comb gap therebetween, said needle beds comprising needles, said needles including planar hooks which define a series of parallel opening planes, and a fabric set-up device comprising a row of gripping means for gripping a knitting thread, said row of gripping means being disposed in a row plane perpendicular to the opening planes of said hooks, each said gripping means including an associated closable thread take-up recess, disposed in and opening up in said row plane, for receiving and trapping the knitting thread, said gripping means being movable in the row plane through the end gap and one of said needle beds being relatively movable parallel to the other said needle bed, and each of said gripping means further comprises a cover rod having a longitudinal axis and lateral opening therein, said lateral opening lateral opening defining an associated said thread take-up recess and a longitudinal slider terminating at one end in a closing protrusion for closing, in the row plane, the take-up recess, said slider being relatively displaceable parallel to said cover rod, and wherein said cover rod comprises, on one lateral side of said thread take-up recess, a projection extending parallel to the row plane of said gripping means, said projection forming one of two spaced edges of said thread take-up recess and terminating in a thread deflection tip projecting beyond said associated slider, said two spaced edges of said thread take-up recess both extending obliquely with respect to said longitudinal axis of said cover rod and toward said closing protrusion of said slider.

* * * * *